US011834238B2

(12) United States Patent
Vila Vilalta et al.

(10) Patent No.: US 11,834,238 B2
(45) Date of Patent: Dec. 5, 2023

(54) CLOSING ELEMENT AND ASSEMBLY FOR A COSMETIC PRODUCT CONTAINER

(71) Applicant: AXILONE METAL SA, Barcelona (ES)

(72) Inventors: Marc Vila Vilalta, Barcelone (ES); Marc Romero Serra, Barcelone (ES); Antoni Cubi Montanya, Barcelone (ES)

(73) Assignee: AXILONE METAL SA, Barcelona (ES)

( * ) Notice: Subject to any disclaimer, the term of this patent is extended or adjusted under 35 U.S.C. 154(b) by 0 days.

(21) Appl. No.: 17/550,581

(22) Filed: Dec. 14, 2021

(65) Prior Publication Data

US 2022/0185551 A1 Jun. 16, 2022

(30) Foreign Application Priority Data

Dec. 15, 2020 (FR) ..... 20 13233

(51) Int. Cl.
*B65D 51/18* (2006.01)
*A45D 40/00* (2006.01)

(52) U.S. Cl.
CPC ..... *B65D 51/18* (2013.01); *A45D 40/00* (2013.01); *A45D 2040/0018* (2013.01); *B65D 2251/0015* (2013.01); *B65D 2251/0078* (2013.01)

(58) Field of Classification Search
CPC ..... B65D 1/18; B65D 2251/0015; B65D 2251/0078; A45D 40/00; A45D 2040/0018
USPC ..... 220/256.1, 784, 794
See application file for complete search history.

(56) References Cited

U.S. PATENT DOCUMENTS 1,596,996 A * 8/1926 Rasmussen ..... B65D 51/18 215/277
2,007,257 A * 7/1935 Scofield ..... B65D 51/18 215/321
2,636,640 A * 4/1953 Bedford, Jr. ..... B65D 51/08 220/784
2,974,815 A * 3/1961 Driscoll ..... B65D 47/265 222/548
4,192,428 A * 3/1980 Segmuller ..... B65D 51/18 215/354

(Continued)

FOREIGN PATENT DOCUMENTS

EP 3 736 227 11/2020

OTHER PUBLICATIONS

Search Report for FR Application No. 2013233 dated Aug. 16, 2021, 9 pages.

*Primary Examiner* — J. Gregory Pickett
*Assistant Examiner* — Niki M Eloshway
(74) *Attorney, Agent, or Firm* — NIXON & VANDERHYE

(57) ABSTRACT

A closing element, among a cover and a ring, for a container for a cosmetic product includes a wall having at least one metallic and elastically deformable connection region, the at least one connection region being partially detached from the rest of the wall. The at least one connection region being adapted to cooperate with another closing element, among the ring and the cover, by elastic deformation so as to removably assemble the two closing elements with each other. A closing assembly for a cosmetic product container is also presented.

20 Claims, 9 Drawing Sheets

(56) References Cited

U.S. PATENT DOCUMENTS

| | | | | |
|---|---|---|---|---|
| 5,269,429 | A * | 12/1993 | Schumacher | B65D 55/0872 215/256 |
| 6,105,817 | A * | 8/2000 | Ponton | B65D 83/40 220/784 |
| 7,909,236 | B2 * | 3/2011 | Erdie | B65D 59/02 229/125.17 |
| 10,111,512 | B2 | 10/2018 | Salciarini et al. | |
| 2010/0290827 | A1 * | 11/2010 | Komatsuda | A45D 40/06 401/98 |
| 2016/0046415 | A1 * | 2/2016 | Buck | B65D 43/026 220/256.1 |
| 2019/0315526 | A1 * | 10/2019 | Gómez Cao | B65D 50/06 |

* cited by examiner

CLOSING ELEMENT AND ASSEMBLY FOR A COSMETIC PRODUCT CONTAINER

CROSS-REFERENCE TO RELATED APPLICATIONS

This application claims priority to French Patent Application No. 20 13233 filed Dec. 15, 2020, the entire contents of which are hereby incorporated by reference.

BACKGROUND OF THE INVENTION

Field of the Invention

The invention relates to the field of containers for cosmetic products, and more particularly closures for such containers.

Description of the Related Art

Every year, millions of cosmetic products (perfumes, lipsticks, mascaras, etc.) of all kinds are sold per second worldwide. Containers are traditionally entirely or in part made up of plastic, and are all waste that can pollute the environment.

Plastic is used not only for its minimal cost, but also for its elastic properties. It is common for the cover to be assembled to the cosmetic container by elastic fitting, also called clipping. This involves locally and temporarily deforming a piece of plastic to insert it into another and thus assemble, for example a cap to its container.

In the field of perfumery, the hoop can be metallic, but the fact remains that the stopper, which has the elastic fitting protrusion, is made up of plastic. There are metal stoppers, but they are conventionally made by stamping, and close the perfume by simple friction against the hoop, with no possible resistance or click, which gives the user the impression of a lower quality product.

SUMMARY OF THE INVENTION

There is proposed a closing element for a cosmetic product container, the closing element being intended to be assembled with another closing element so as to form a closing assembly composed of a cover and a ring, the closing element comprising:

- a wall having at least one metallic and elastically deformable connection region, said at least one connection region being partially detached from the rest of the wall, and
- said at least one connection region being adapted to cooperate with the other closing element by elastic deformation so as to removably assemble the two closing elements with each other.

Thanks to the elastically deformable connection region (that is to say undergoing elastic deformation), an elastic fitting can be achieved between two closing elements, that is to say between a ring and a cover.

Not only does the metal construction avoid potentially polluting plastic, but it also gives a luxury aspect to the container by producing a muffled and generous closing sound.

The features exposed in the following paragraphs can, optionally, be implemented. They can be implemented independently of each other or in combination with each other:

- the wall is metallic and said at least one connection region is formed integrally with the wall.

- said connection region comprises a tab.
- the tab comprises a protuberance adapted to cooperate with the other closing element so as to removably assemble the elements with each other.
- the protuberance is integrally formed with the tab, preferably by stamping.
- the tab is of parallelepiped shape and connected to the rest of the wall by at least one side.
- the tab is connected to the rest of the wall by only two sides, adjacent sides or two opposite sides.
- the tab comprises a flat surface and transition surfaces, preferably inclined, respectively extending between said two sides and the flat surface.
- the wall is made of aluminum or an aluminum alloy, preferably anodized.
- the closing element is a cover and the wall is an internal wall of the cover, and the other closing element is a ring of the container.
- the closing element comprises an external cover and an internal cover mounted inside the external cover, and the inner wall is an inner wall of the internal cover.
- the internal cover has a lower part which conforms to the internal wall of the external cover, and an upper part at a distance from the internal wall of the external cover.
- the closing element is a ring adapted to be fixed to the container.

There is also proposed a closing assembly for a container for a cosmetic product, including:

- the closing element defined according to one or more of the above features; and
- the other closing element, wherein the closing element cooperates with the other closing element between a closed position and an open position, one or the other of the closing element and the other closing element being adapted to be associated with the cosmetic product container.

BRIEF DESCRIPTION OF THE DRAWINGS

Other features, details and advantages of the invention will appear from the detailed description hereinafter, and from considering the enclosed drawings, wherein.

DESCRIPTION OF THE PREFERRED EMBODIMENTS

The drawings and the description below essentially contain elements of a certain nature. They can therefore not only serve to better understand this invention, but also contribute to its definition, where applicable.

Figure 1:
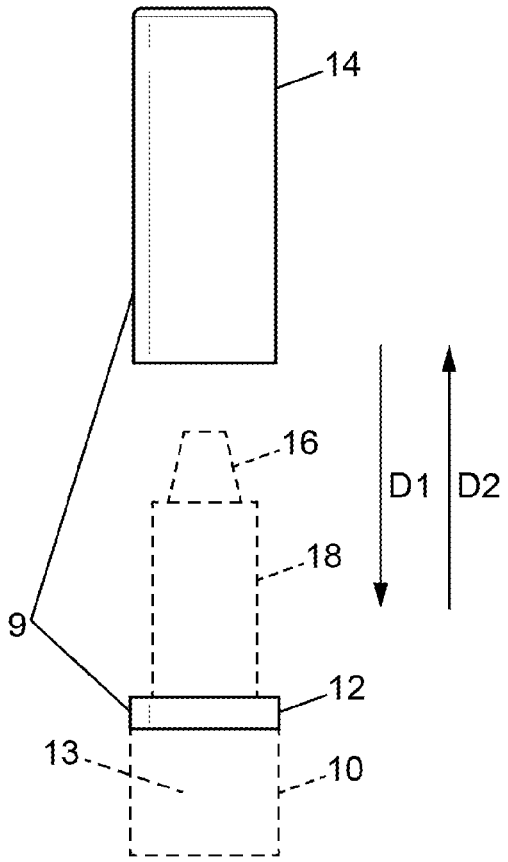
FIG. 1 is a front elevation view of a container closing assembly for a cosmetic product, according to an embodiment, the assembly comprising a removable cover and a ring on the container, the container being a lipstick shown in dotted lines.

Reference is now made to FIG. 1, which shows a closing assembly 9 of a cosmetic product container 10. The closing assembly 9 comprises a closing element in the form of a cover 14, and another closing element in the form of a ring 12 of the container 10. The two closing elements are adapted to cooperate with each other. The ring 12 cooperates with the cover 14 between a closed position and an open position (illustrated in FIG. 1). The ring and the cover 14 are two independent items which may or may not be assembled with each other depending on whether it is desired to access the cosmetic product. The ring 12 can be a part attached to the container 10 such as e.g. a hoop of a perfume bottle, or be integrally formed with the container, such as for example a section (in plastic or not) of a lipstick type container.

Figure 2:
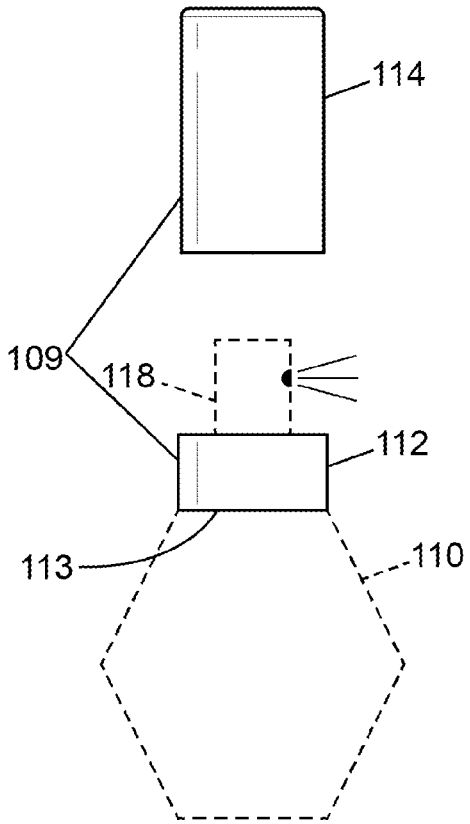
FIG. 2 is a front elevation view of a container closing assembly for a cosmetic product, according to an embodiment, the assembly comprising a removable cover and a ring on the container, the container being a perfume bottle shown in dotted lines.

The cosmetic product container can be any container accommodating a liquid, semi-liquid or solid cosmetic product. For example, a perfume, a lipstick, a jar of cream, a mascara, or even a gloss, nail polish, the list being non-exhaustive. It can be made of various materials: glass, metal, plastic for example. In the example of FIG. 1, the container 10 is a lipstick (illustrated in dotted lines) and the cosmetic product is a lipstick stick 16. In the example of FIG. 2, the container 10 is a perfume bottle 110 (illustrated in dotted lines). A closing assembly 109 for the container 110 is similar to assembly 9, and includes a cover 114 and an associated ring 112. The cover 114 makes it possible to protect a dispensing mechanism 118 for dispensing the perfume, herein a spray diffuser. The ring 112 is a hoop arranged around a neck 113 of the perfume bottle. The cover 114 and ring 112 may come as any embodiment discussed below with respect to the cover 14 and ring 12 (and vice versa). Hereinafter, the lipstick 10 example or the perfume bottle 110 example will be used in turns to illustrate different embodiments of the closing assembly, without the described cover and/or ring and/or closing assembly being linked to the container type. The word "ring" is used in this specification to designate a part of the container (a part which is attached or not) with which the cover cooperates, without implying that this part has a particular shape, such as, for example, annular. The cover can be any closing means for a cosmetic product container, for example, a cap, a stopper or a lid.

The container 10 shown in dotted lines in FIG. 1 is a lipstick case. The cover 14 serves to protect the lipstick stick 16 (in French: "raisin de rouge à lèvres") from the container 10. When the cover 14 is in a closed position, that is to say assembled to the container 10, the lipstick stick 16 is protected from the external environment. When the cover 14 is in the open position (as illustrated in FIG. 1), the stick 16 is exposed and accessible for application thereof by a user.

The container 10 further includes part of a lipstick dispensing mechanism 18. The dispensing mechanism 18 is a conventional lipstick dispensing mechanism, and will not be discussed in detail here. The stick 16 can be secured with the rest of the container 10, so that when the lipstick is finished, the whole container 10 can be discarded. According to another embodiment, the stick 16 (and possibly part of the dispensing mechanism 18) can be removable from the container 10, so that the stick, when finished, can be replaced by another stick compatible with the container 10, without throwing away the container 10. The ring 12 is arranged around a base 13 of the lipstick, which is used to put the dispensing mechanism 18 into action.

Assembling the cover 14 on the container 10 is typically carried out translating one towards the other (movement direction D1), which results in a friction of one in the other until the cover 14 is engaged on the ring 12. The cover 14 is reversibly friction fitted to ring 12. It can be disassembled from the ring 12 translating in a movement direction D2 opposite to D1. As will be discussed below, assembling, according to certain embodiments, can also be carried out by elastic fitting the ring 12 with respect to the cover 14, that is to say by clipping.

The cover 14 and the associated ring 12 are shown here as having a circular section. It could however be that the cover 10 and the ring 12 are of different shapes, for example have an elliptical or square or hexagonal cross-section.

Figure 3:
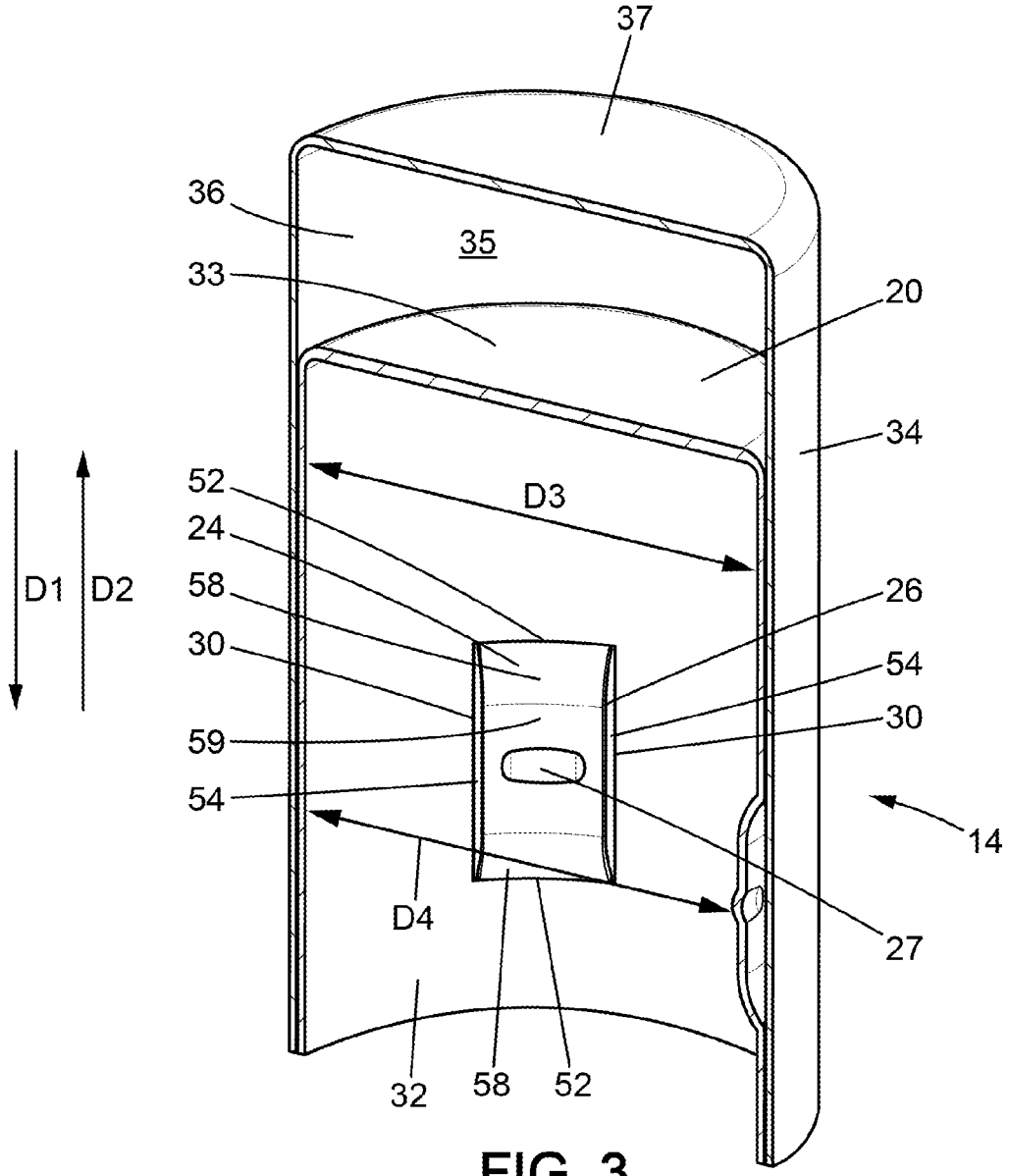
FIG. 3 is a perspective view of the cover of FIG. 1, revealing the inside of the cover and several tabs for connecting the cover to the container.

Referring to FIG. 3, the cover 14 and its interaction with the ring 12 to ensure reversibly closing the container 10 will be discussed in greater detail. As said above, the features of the cover 14 of the lipstick container 10 are applicable to the cover 114 for the perfume bottle container 110. In order not to overload the text, similar numerical references will be used in different hundreds to describe different embodiments of the cover (applicable to any cosmetic product container) without however describing the same elements in detail again.

Assembling the cover 14 onto the container 10 is carried out between an internal wall 20 of the cover 14 and the ring 12 of the container 10 translating from one to the other in the movement direction D1, D2. The ring 12 with which the inner wall cooperates can be made up of various materials. It can be, for example, metallic, or in plastic, or in glass.

According to an embodiment, the internal wall 20 is an internal wall of an internal cover 32, and the cover 14 is then the assembly having the internal cover 32 and an external cover 34 serving as an embellisher mounted on the outside of the internal cover 32. The two can be fixed together, for example by a glue, or just fixedly assembled with each other by friction. The external cover 34 can be made up of any material and have any desired shape. The external cover 34 makes it possible to hide the internal cover 32 from the eye of the user.

The internal wall 20 has one or more metallic and elastically deformable connection regions 24. The connection regions 24, by deforming elastically when they meet the ring 12, allow multiple fitting and unmounting of the cover 14 onto/from the ring 12 between the closed and open positions.

According to an embodiment, the connection regions 24 are integrally formed with the internal wall 20 so that the internal wall and the connection regions 24 are made of the same metallic material. According to another embodiment, the connection regions 24 are fixed to the internal wall 20, for example welded if the internal wall 20 is metallic, or glued or fixedly fitted (for example clipped or in a captive connection). In the latters, the internal wall 20 can be metallic or in plastic.

In the embodiment of FIG. 3, the internal wall 20 of the cover 14 has three connection regions 24 facing each other and equidistant from each other (one being visible and another one partially visible). It could, however, be that the inner wall 20 has just one, two, or more than three connection regions 24. The number and positions of the connection regions 24 may depend on the cover 14 shape and of the desired resistance level to opening. For example, if the cover 14 has a square section, the connection regions 24 may be on two opposite sides of the inner wall 20 of the cover 14.

In what follows, a single connection region 24 will be described as an example of an elastically deformable connection region. The connection regions 24 of a cover 14 can be identical to each other, or be different from each other, for example by adopting one or more of the embodiments described below.

The shape and construction of the connection region 24 are specifically chosen so as to make it possible to achieve reversible fitting of the cover 14 on the ring 12, although the internal wall 20 thereof is metallic. To this end, the elastic region at which the metal of the connection region 24 is deformed is exploited. According to an embodiment, each of the connection regions 24 comprises an elastically deformable connection tab 26 partially detached from the rest of the internal wall 20. The tab 26 is adapted to cooperate elastically with the ring 12 for the cover 14 to be assembled to the ring 12 numerous times. The tab 26 is deformed over the assembling and disassembling operations of the cover 14 on the ring 12 without losing its original shape once at rest (that is to say when the cover 14 is disengaged from the ring 12).

Metal is known to be a plastic material, that is, when deformation is imparted to it, it remains in a non-initial, deformed shape, even after the deformation force is withdrawn. However, the metal under some weak deformation forces has an elastic deformation region, wherein when imparted a deformation, it returns to its original shape, after the deformation force is withdrawn. The connection region 24, in particular the tab 26, have sizes and shapes chosen so that the tab 26 remains in the elastic deformation region of the metal constituting it when the cover 14 is assembled to the ring 12.

Figure 4:
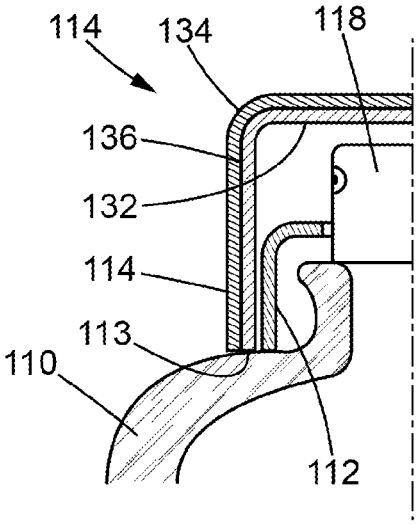
FIG. 4 is a partial cross-sectional view showing a closing assembly, according to an embodiment, assembled to the perfume container of FIG. 2, the assembly comprising a cover and a ring, the cover being made of an internal cover mounted inside an external cover.
Figure 5:
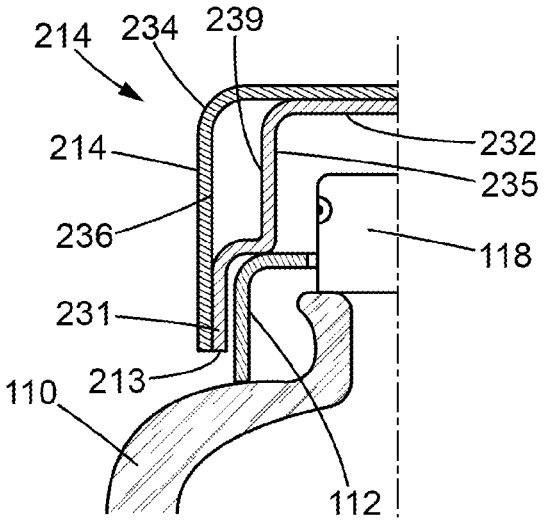
FIG. 5 is a partial cross-sectional view showing a closing assembly, according to an embodiment, assembled to the perfume container of FIG. 2, the assembly comprising a cover and a ring, the cover being made of an internal cover mounted inside an external cover.
Figure 6:
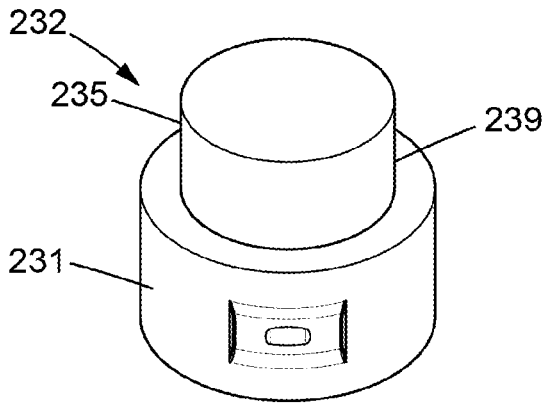
FIG. 6 shows a perspective view of the internal cover according of FIG. 5 to an embodiment.
Figure 7:
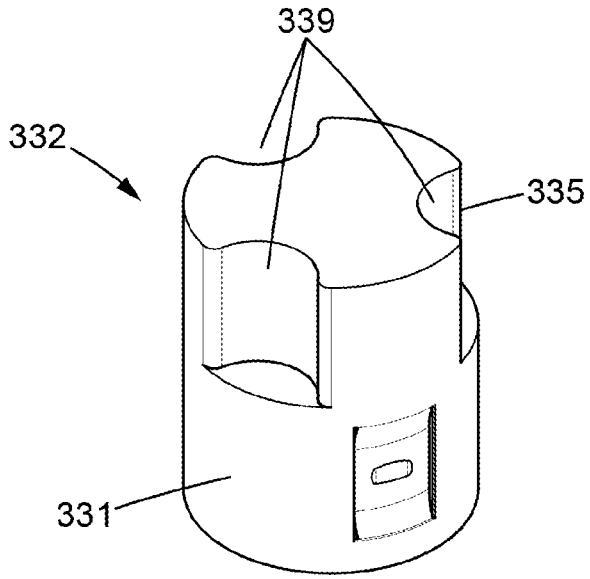
FIG. 7 shows a perspective view of an internal cover according to another embodiment.

According to an embodiment, the internal cover 32 comprises a cylindrical body and has a closed end 33. According to an embodiment, the internal cover 32 conforms to an internal wall 36 of the external cover 34. In the example of FIG. 3, the internal cover 32 has its closed end 33 spaced apart from a closed end 37 of the external cover 34. An interval 35 between the closed ends of the internal cover 32 and the external cover 34 could for example be used to add weight to the cover 14. The internal cover 32 could however, at its closed end 33, be in contact with the external cover 34. In the example of FIGS. 4 and 5, covers 114, 214 are formed by internal covers 132, 232, the closed end of which being in contact with that of the external cover 134, 234. According to another embodiment, the internal cover can be, in places, at a distance from the internal wall of the external cover. FIGS. 5, 6 and 7 show examples of internal covers 232, 332 having a lower part 231, 331 which conforms to the internal wall of the external cover, and an upper part 235, 335 which is at a distance from the internal wall of the external cover. In the example of cover 214 of FIGS. 5 and 6, the entire upper part 235 of the internal cover 232 is at a distance from the internal wall 220 of the external cover 234, so as to form a crown 239 reinforced with respect to the lower part 231. In the example of FIG. 7, only discrete portions of the upper part 335 of the internal cover 332 are at a distance from the internal wall of the external cover, such as for example the three portions 339. Chosing between the different internal cover shapes can also be made depending on the choice of regions on which the cover should bear on the container. For example, in the example of FIG. 4, a lower end 113 of the cover 114 contacts the perfume bottle 110, while in the example of FIG. 5, an edge created by the crown 239 allows resting the cover 214 on the ring 112, so as to create a distance between a lower end 213 of the cover 214 (the cover open end) and the container 110. According to another embodiment, the internal cover 32 is a sheath, open at each end.

With reference again to FIG. 3, the connection region 24 (and therefore the tab 26) is preferably made of aluminum or of an aluminum alloy, preferably anodized. The connection region 24 could also be made of steel, or even of stainless steel.

According to an embodiment, the internal cover 32 and the connection region 24 (and therefore tab) are integrally formed with each other out of metal as discussed above. In this case, the internal cover 32 is formed by stamping from a sheet made of the metallic material. The tab 26 can be formed in the internal cover 32 thus extruded by cutting and stamping. To this end, one or more incisions 30 are made in the internal wall 20 and the shape thus cut out is deformed by stamping so as to move away and be partially detached from the rest of the internal wall 20 and thus forming the tab. In the example of FIG. 3, two opposite rectilinear incisions 30 are made so as to form the tab 26. Various tab shapes and incisions are possible. Various examples will be given below.

Several factors go into the design of the tab to make it elastically deformable even though it is made of metal. These factors include, but are not limited to, one or more of: the tab size, the incisions' size relative to the size of the sides to which the tab is attached, the tab thickness, the surface area of the tab in relation to the size of the sides to which the tab is attached, the material. Thus, a tab having a large incision size will be more adapted to be deformed than a tab having a small incision size (other factors being equal). For example, a rectangular tab having the long sides incised will be more flexible than a tab of the same shape and size having its short sides incised. If the tab is subject to too much deformation, the deformation may be plastic, that is to say irreversible. In this case, there will be no more elastic fitting connection. If, on the other hand, the tab is subject to too little or no deformation at all, elastic fitting will also not be able to take place. Thus, the tab is designed to be neither too much nor too little deformable, so as to remain within the elastic deformation range of the material.

According to an embodiment, the tab 26 further comprises a protuberance 27 adapted to cooperate with the ring 12 in order to assemble the cover 14 to the ring 12. The protuberance 27 makes it possible to engage the ring 12 by additional friction. Each tab 26 could have more than one protuberance 27, such as for example two adjacent protuberances, or no protuberance. If the cover 14 includes more than one tab, only certain tabs could have the protuberance. The protuberance 27 can be integrally formed with the tab 26, for example by stamping. According to another embodiment, the protuberance 27 is a part distinct from the tab 26 itself, for example glued, or a welding spot on the tab 26.

Figure 8:
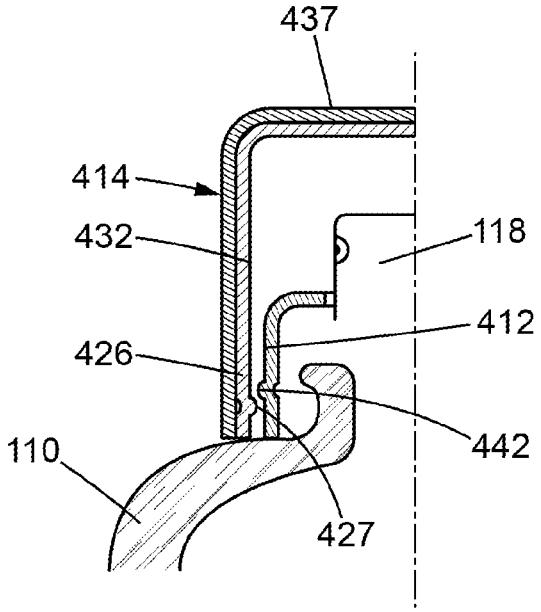
FIG. 8 is a partial cross-sectional view showing a closing assembly, according to an embodiment, assembled to the perfume container of FIG. 2, the assembly comprising a cover and a ring.

The protuberance 27 illustrated in FIG. 3 is shaped like a rice grain. It could however be that the protuberance can have various shapes, such as for example, the shape of a disc or of a bar. The protrusion 27 can be located in the middle of the tab, as illustrated in FIG. 3, or at the edge of the tab as illustrated in FIG. 8.

According to another embodiment, the tab could have a recess instead of or in addition to the protuberance 27 which would cooperate with a protrusion of the ring.

In order to ensure reversible fitting and the elastic deformation of the tab 26, an internal diameter D1 of the internal cover 32 may be substantially greater than a diameter D2 of the ring 12 to ensure friction between the two. According to one example, an interference between the ring 12 and the inner wall 20 of the internal cover 32 is about 3/10 of a millimeter. The internal diameter D1 of the internal cover 32 is calculated as being the smallest distance between two opposite points of the internal wall 20. This is, for example, a tab-to-tab or protuberance-to-protuberance distance if the tab has a protuberance.

Figure 9:
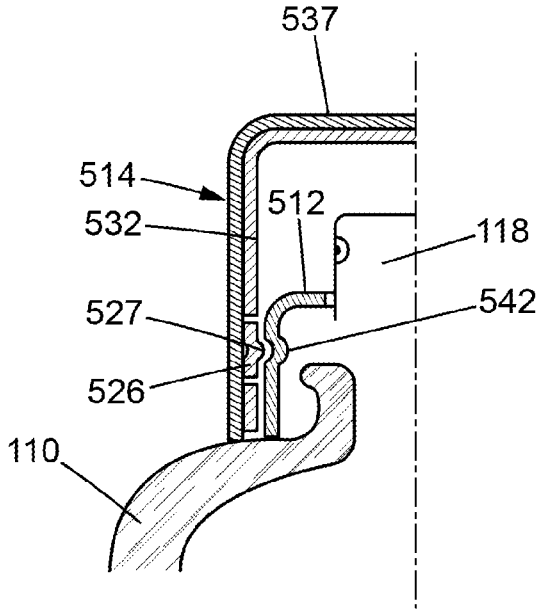
FIG. 9 is a partial cross-sectional view showing a closing assembly, according to an embodiment, assembled to the perfume container of FIG. 2, the assembly comprising a cover and a ring.

The ring 12 can come in various shapes chosen to cooperate with the cover 14. The ring 12 can be smooth (like the ring 12 illustrated in FIGS. 1, 2 or the ring 112 of FIGS. 4 and 5) and the connection between the cover 14 and the ring 12 is then ensured by simple friction of the tab on the ring. According to another embodiment, the ring 12 may have indentations or protuberances (rib or groove) adapted to cooperate with the tab, to provide friction by means of elastic fitting. For example, FIG. 8 illustrates a ring 412 having a protuberance 442. Protuberance 442 can be discrete so that for example the ring 412 has a series of protuberances arranged circumferentially. This protuberance 442 can also be of annular shape on the ring 412. There could also be several annular protuberances. The protuberance 442 can cooperate with a groove arranged in a tab of a cover. The protuberance of the ring can also cooperate with a protuberance of the tab, as in the example of FIG. 8 where the protuberance 442 of the ring 412 cooperates with a protuberance 427 of a tab 426. According to another example, as illustrated in FIG. 9, a ring 512 has a groove 542. The groove 542 is for example annular in shape and adapted to cooperate with a protuberance 527 of a tab 526 of a cover 514.

The tab can come in various shapes. In the example of FIG. 3, the tab 26 is rectangular. It is connected to the rest of the inner wall 20 by only two of its sides, two opposite short sides 52, and at a distance from the inner wall 20 along two opposite long sides 54. The sides by which the tab 26 is connected to the rest of the internal wall 20 are preferably sides transverse to the movement directions D1, D2 of the cover 14. In the example of FIG. 3, the opposite long sides 54 of the tab 26 are arranged parallel to the movement direction D1, D2 and are also the incised sides, and therefore at a distance from the internal wall 20. According to an embodiment, the tab 26 has two transition surfaces 58 extending from the short sides 52 and a flat surface 59. The flat surface 29 accommodates the protuberance 27. When the tab does not have a protuberance, the flat surface corresponds to a contact region with the ring. When the tab has a protuberance, the protuberance is a contact region with the ring. The transition surfaces 58 make it possible to ensure a gradual transition between the largest diameter of internal wall 20, i.e. diameter D3, and the smallest diameter of internal wall 20, i.e. diameter D4, corresponding to the diameter at the tab 26, and more precisely at the protuberance 27 if the tab 26 has such a protuberance. The transition surfaces 58 are, in this embodiment, inclined surfaces. However, it could be that the transition surfaces 58 are curved surfaces allowing a gradual transition between the inner wall 20 and the planar surface 59. The tab 26 might not have the inclined surfaces 58, so that the transition between the inner wall 20 and the planar surface 59 is like a step. The tab 26 could also have no flat surface and be of domed shape.

Figure 10:
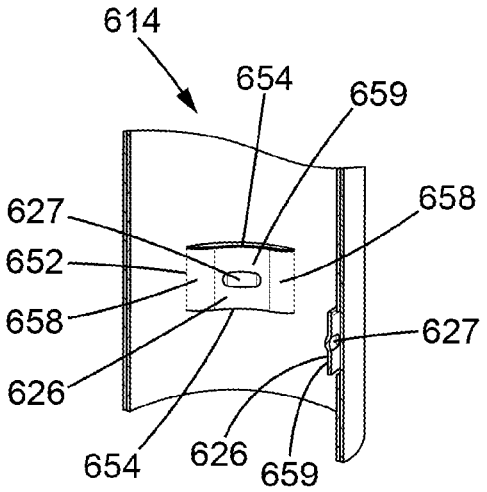
FIG. 10 shows a perspective view in partial cross-section of a cover, according to an embodiment, revealing an elastically deformable connection region, in particular a connection tab.

The tab 26 could alternatively be connected by the opposite long sides 54. In this case, the tab 26 would preferably be arranged on the internal wall 20 so that the long sides 54 are transverse to the movement direction D1, D2. FIG. 10 shows a tab 626 having such a configuration. The tab 626 is rectangular in shape and has two short sides 654 disposed in a direction parallel to the movement direction D1, D2 (the short sides are disconnected from the inner wall), and two long sides 652 (the long sides are connected to the rest of the internal wall) in a direction transverse to the movement direction D1, D2. Similar to tab 26, tab 626 has a planar surface 659 and two inclined surfaces 658 extending between each of the short sides 654 and the planar surface 659. Similar to tab 26, inclined surfaces 658 could be omitted. The tab 626 includes a protuberance 627 on the planar surface 629. The protuberance 627 similar to that described below and its alternatives, could be omitted.

Figure 11:
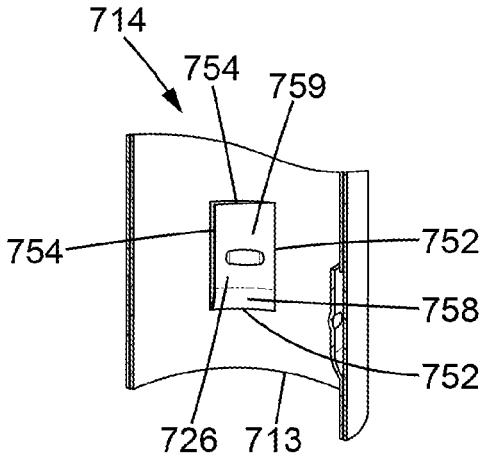
FIG. 11 shows a perspective view in partial cross-section of a cover, according to an embodiment, revealing an elastically deformable connection region, in particular a connection tab.

The parallelepiped shaped tab could alternatively be connected to the internal wall by adjacent sides and not by opposite sides. Such a tab 726 for cap 714 is illustrated in FIG. 11. The tab 726 is connected to the rest of the internal wall by two adjacent sides 752 and at a distance from the internal wall by the two other adjacent sides 754. Preferably, and as illustrated in FIG. 11, the side of the tab 726 which is connected to the internal wall and which is transverse to the movement directions D1, D2 is a side proximal to an open end 713 of the cap 714.

Figure 12:
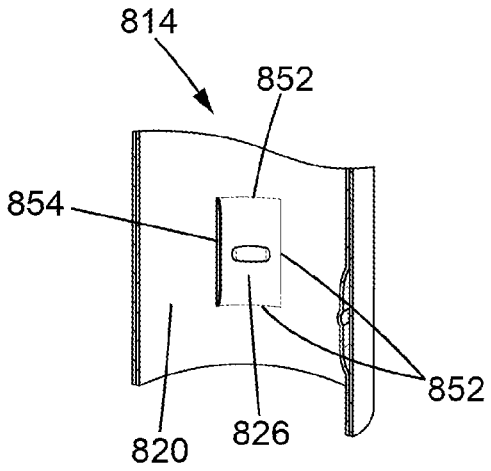
FIG. 12 shows a perspective view in partial cross-section of a cover, according to an embodiment, revealing an elastically deformable connection region, in particular a connection tab.

According to another embodiment, the parallelepiped tab may also be connected by three sides. Such a tab 826 for cap 814 is illustrated in FIG. 12. The tab 826 is connected to the rest of the internal wall by three adjacent sides 852 and at a distance from the internal wall by a side 854. Preferably, and as illustrated in FIG. 12, the side 854 of the tab 826 which is disconnected from the internal wall is a side parallel to the movement directions D1, D2.

According to another embodiment, the parallelepiped tab may also be connected by a single side.

Figure 13:
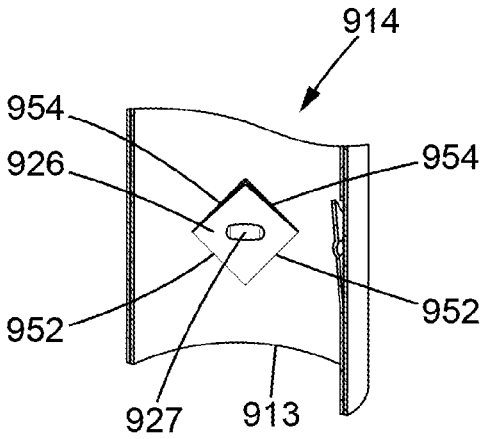
FIG. 13 shows a perspective view in partial cross-section of a cover, according to an embodiment, revealing an elastically deformable connection region, in particular a connection tab.

According to another embodiment, the parallelepiped tab can be positioned so that one or several of the sides thereof are at a non-zero and non-perpendicular angle with the movement direction D1, D2. Such a tab 926 for cap 914 is illustrated in FIG. 13. Preferably, and as illustrated in FIG. 13, the sides of the tab 926 which are disconnected from the internal wall 920 are distal sides 954 at the open end 913 of the cap 914, and the sides of the tab 926 which are connected from inner wall 920 are proximal sides 954, proximal to the open end 913 of cap 914. The tab could be disconnected by only one of the two distal sides 954. Although the tab 926 shown in FIG. 13 is not, the tab 926 could have features of the other tabs discussed above, such as transition surfaces.

Figure 14:
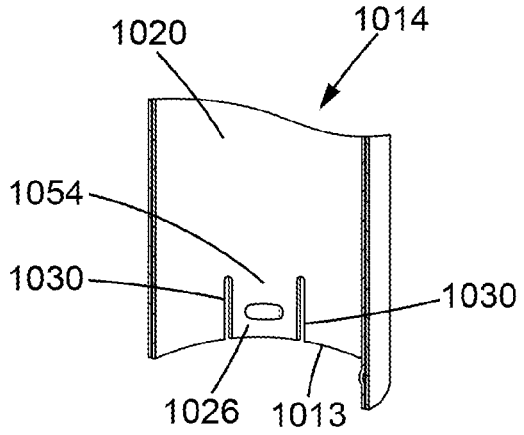
FIG. 14 shows a perspective view in partial cross-section of a cover, according to an embodiment, revealing an elastically deformable connection region, in particular a connection tab.

The tabs described above and illustrated in FIGS. 3 to 13, are disposed spaced apart from the open end of the cap. However, it could be that the tab has one side disposed at the open end of the cap. Such a tab 1026 for cap 1014 is illustrated in FIG. 14. The tab 1026 is formed by two incisions 1030 in the inner wall 1020 which communicate with an open end 1013 (i.e. the end proximal to the container 10) of the cap 1014. The tab 1026 is connected to the rest of the inner wall 1020 by a single side 1054, distal from the open end 1013 of the cap 1014. Although the illustrated tab 1026 is not, in an embodiment, the tab 1026 could include an inclined or transition surface similar to those described above, between side 1054 and a flat surface of the tab 1026.

Figure 15:
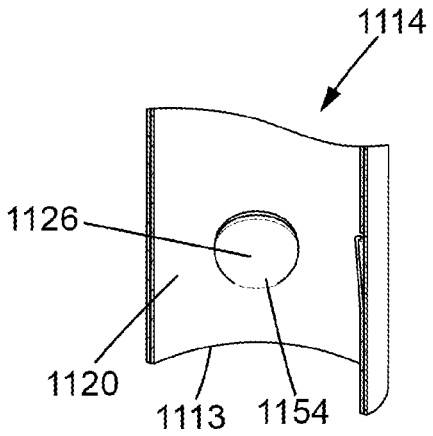
FIG. 15 shows a perspective view in partial cross-section of a cover, according to an embodiment, revealing an elastically deformable connection region, in particular a connection tab.

According to another embodiment, the tab is not of parallelepiped shape. An example of such a tab 1126 of a cover 1124 is illustrated in FIG. 15. The tab 1126 is circular in shape and connected to the rest of the internal wall by an arc of a circle. For example, the arc of a circle is a semicircle, or three-quarters of a circle. According to another example, the tab 1026 is at a distance from the rest of the internal wall 1120 in several places on the circle. It can for example be connected to the rest of the internal wall in three points or regions equidistant from the circle. The circular shape is not necessarily a circle. The circular shape could be an oval or any other curved shape. Preferably, and as illustrated in FIG. 15, the tab 1126 is connected to the rest of the internal wall 1120 by a portion 1154 proximal to the open end 1113 of the cap 1114. The disconnected portion could have an edge as shown in FIG. 15.

The connection tab could have a shape comprising curved portions and rectilinear portions, forming in a way a mixture of the above embodiments.

In all of the above, a closing assembly has been illustrated in which the closing element, which included the elastic deformation region (and therefore the tab), was the cover. It could however be that the closing element which includes the elastic deformation region is the ring, so that the closing capacities of the cover and of the ring are reversed compared to what has been written so far. Thus, without repeating the above, the ring would have an outer wall similar to the inner wall described below and one or more elastically deformable connection regions as discussed above. The internal cover cooperating with such a ring having elastic deformation regions would then have the features described above with regard to the ring, such as a protrusion or a groove or a smooth wall. It could also be that each of the closing elements (cover and ring) have elastic deformation regions so as to cooperate with each other.

According to an example, the closing elements may have the following clauses:

Clause A. Cover (14, 114, 214, 414, 514, 614, 714, 814, 914, 1014, 1114) for a container (10, 110) for cosmetic product comprising:

a metallic internal wall (20, 120) having at least one elastically deformable connection region (24), said at least one elastically deformable connection region (24) comprising a tab (26, 126, 426, 526, 626, 726, 826, 926, 1026, 1126) partially detached from the rest of the internal wall, and the tab being adapted to cooperate with a ring (12, 112) of the container by elastic deformation for removably assembling the cover with the container.

Clause B. Cover according to clause A, wherein the tab is integrally formed with the inner wall.

Clause C. Cover (14, 114, 214, 414, 514, 614, 714, 814, 914, 1014, 1114) according to clause A or B, wherein the tab comprises a protuberance (27, 527, 627) adapted to cooperate with the ring to removably assemble the cover to the container.

Clause D. Cover (14, 614, 714, 814, 914) according to clause A to C, wherein the tab (26, 626, 726, 826, 926) is of parallelepiped shape and connected to the rest of the inner wall (20) by at least two sides (52, 652, 752, 852, 952).

Clause E. Cover (14, 614, 714, 914) according to clause A to D, wherein the tab (26, 626, 726, 926) is connected to the rest of the inner wall (20) by only two sides, and the two sides are adjacent sides (752) or opposite sides (52, 652, 952).

Clause F. Cover (14, 614, 714, 914) according to one of clauses A to E, wherein the tab (26, 626, 726) comprises a flat surface (59, 659, 759) and transition surfaces (58, 658, 759), preferably inclined, extending between said at least two sides and the flat surface.

Clause G. Coved (14, 114, 214, 414, 514, 614, 714, 814, 914, 1014, 1114) according to one of clauses A to F, wherein the protuberance is integrally formed with the tab, preferably by stamping.

Clause H. Cover (14, 114, 214, 414, 514, 614, 714, 814, 914, 1014, 1114) according to one of clauses A to F, wherein the internal wall is made of aluminum or an aluminum alloy, preferably anodized.

Clause I. Cover (14, 114, 214, 414, 514, 614, 714, 814, 914, 1014, 1114) according to one of clauses A to H, wherein the closing element comprises an external cover (34, 134, 234) and an internal cover (32, 232, 332) mounted inside the external cover, and the inner wall is an inner wall of the internal cover.

Clause J. Cover (14, 114, 214, 414, 514, 614, 714, 814, 914, 1014, 1114) according to the preceding clause, wherein the internal cover has a lower part (231, 331) which conforms to the internal wall of the external cover, and an upper part (235, 335) at a distance from the internal wall of the external cover.

Clause K. closing assembly (9, 109) of a container (10, 110) for cosmetic product, comprising:

the cover according to one of clauses A to J; and a ring (12, 112) adapted to be associated with the cosmetic product container, the ring cooperating with the cover between a closed position and an open position.

Clause L. closing assembly for a container for a cosmetic product, comprising:

a cover; and a ring adapted to be fixed to the cosmetic product container, the ring cooperating with the cover between a closed position and an open position, the cover or the ring having at least one elastically deformable connection region integrally formed of the same material as said cover or ring, said at least one elastically deformable connection region comprising a tab partially detached from the rest of said cover or ring, and the tab being adapted to cooperate elastically with the other one of said cover or ring to removably assemble the cover to the ring.

The invention claimed is:

1. Closing element for a container for cosmetic product, the closing element being a first closing element intended to be assembled to a second closing element of the container so as to form a closing assembly, the first closing element being one of a cover and a ring of the container, the second closing element being another one of the ring and the cover of the container, the first closing element comprising:

a wall having at least one metallic and elastically deformable connection region in the shape of a tab, said at least one connection region being partially detached from the rest of the wall and connected to the rest of the wall by at least two sides, the at least two sides including two adjacent sides or two opposite sides, and said at least one connection region being adapted to cooperate with the second closing element by elastic deformation so as to removably assemble the first and second closing elements with each other and said at least one connection region, in the shape of the tab, is deformed over plural assembling and disassembling operations of the cover on the ring without losing an original shape of the tab once at rest when the cover is disengaged from the ring.

2. The closing element according to claim 1, wherein the wall is metallic and said at least one connection region is formed integrally with the wall.

3. The closing element according to claim 1, wherein the tab comprises a protuberance adapted to cooperate with the second closing element so as to removably assemble the elements with each other.

4. The closing element according to claim 3, wherein the protuberance is integrally formed with the tab.

5. The closing element according to claim 1, wherein the original shape of the tab is a parallelepiped shape and connected to the rest of the wall by at least one side.

6. The closing element according to claim 1, wherein the tab is connected to the rest of the wall by only two sides.

7. The closing element according to claim 1, wherein the tab comprises a flat surface and transition surfaces, respectively extending between said at least two sides and the flat surface.

8. The closing element according to claim 1, wherein the wall is made of aluminum or an aluminum alloy.

9. The closing element according to claim 1, comprising an external cover and an internal cover mounted inside the external cover, and the wall of the first closing element is an inner wall of the internal cover.

10. The closing element according to claim 9, wherein the internal cover has a lower part which conforms to an internal wall of the external cover, and the internal cover has an upper part at a distance from the internal wall of the external cover.

11. The closing element according to claim 1, wherein the first closing element is a ring adapted to be fixed to the container.

12. Closing assembly of a container for cosmetic product, comprising:

a first closing element and a second closing element, the first closing element including:

a wall having at least one metallic and elastically deformable connection region in the shape of a tab, said at least one connection region being partially detached from the rest of the wall and connected to the rest of the wall by at least two sides, the at least two sides including two adjacent sides or two opposite sides, and said at least one connection region being adapted to cooperate with the second closing element by elastic deformation so as to removably assemble the first and second closing elements with each other; and wherein the first closing element cooperates with the second closing element between a closed position and an open position, one of the first closing element and the second closing element being adapted to be associated with the cosmetic product container and said tab is elastically deformed over plural assembling and disassembling operations of the first closing element and the second closing element without losing an original shape of the tab once at rest when the first closing element is disengaged from the second closing element.

13. The closing assembly according to claim 12, wherein the first closing element is a cover and the wall is an internal wall of the cover, and the second closing element is a ring of the container.

14. Closing element for a container for cosmetic product, the closing element comprising:

a first closing element, the first closing element being one of a cover and a ring of the container;

a second closing element, the second closing element being another one of the ring and the cover of the container;

the first closing element intended to be assembled to the second closing element so as to form a closing assembly, the first closing element comprising:

a wall having at least one metallic and elastically deformable connection region in the shape of a tab, said at least one connection region being partially detached from a remainder of the wall and connected to the remainder of the wall by at least two sides, the at least two sides including two adjacent sides or two opposite sides, said at least one connection region being adapted to cooperate with the second closing element by elastic deformation so as to removably assemble the first and second closing elements with each other, and wherein the first closing element cooperates with the second closing element between a closed position and an open position, one of the first closing element and the second closing element being adapted to be associated with the cosmetic product container and said tab is deformed over plural assembling and disassembling operations of the cover on the ring without losing an original shape of the tab once at rest when the cover is disengaged from the ring.

15. The closing assembly according to claim 14, wherein the first closing element is a cover and the wall is an internal wall of the cover, and the second closing element is a ring of the container.

16. The closing assembly according to claim 14, wherein the at least two sides include two adjacent sides.

17. The closing element according to claim 16, wherein the tab is connected to the remainder of the wall by only the two adjacent sides.

18. The closing assembly according to claim 14, wherein said the at least two sides include two opposite sides.

19. The closing element according to claim 18, wherein the tab is connected to the remainder of the wall by only the two opposite sides.

20. The closing assembly according to claim 14, wherein the tab comprises a protuberance adapted to cooperate with the second closing element so as to removably assemble the elements with each other, the protuberance is integrally formed with the tab.

* * * * *